US005411318A

United States Patent [19]

Law

[11] Patent Number: 5,411,318

[45] Date of Patent: May 2, 1995

[54] EXTENDED VENTILATING SEAT COVERING ASSEMBLY

[76] Inventor: Ignace K. Law, P.O. Box 6803, Alhambra, Calif. 91802

[21] Appl. No.: 110,846

[22] Filed: Aug. 24, 1993

[51] Int. Cl.[6] ..... A47C 7/02

[52] U.S. Cl. ..... 297/452.45; 297/180.11; 5/468

[58] Field of Search ..... 297/452.45, 452.43, 297/452.42, 180.11; 5/468, 421

[56] References Cited

U.S. PATENT DOCUMENTS

| | | | |
|---|---|---|---|
| 1,982,816 | 11/1934 | Holmsted | 297/452.45 X |
| 3,014,226 | 12/1961 | Wilfert | 5/468 |
| 3,137,523 | 6/1964 | Karner . | |
| 3,278,226 | 10/1966 | Magnusson | 297/180.11 X |
| 4,313,640 | 2/1982 | Trotman et al. . | |
| 4,435,015 | 3/1984 | Trotman et al. . | |
| 4,529,248 | 7/1985 | Trotman et al. | 297/452.45 |
| 4,614,000 | 9/1986 | Mayer | 5/468 X |
| 4,981,324 | 1/1991 | Law . | |

FOREIGN PATENT DOCUMENTS

| | | | |
|---|---|---|---|
| 256010 | 2/1963 | Australia | 297/452.43 |
| 2132741 | 1/1973 | Germany | 297/452.45 |

*Primary Examiner*—Laurie K. Cranmer
*Attorney, Agent, or Firm*—Poms, Smith, Lande & Rose

[57] ABSTRACT

An extended ventilated seat covering assembly includes a backing sheet, and protrusions, studs or spacing members extending outward from the backing sheet to support the user, with the sides of the assembly extending laterally beyond the normal seating area of the user, and being entirely open at the outer edges to permit the free circulation of cooling air. When employed with bucket seats, the assembly may include a basic central area, additional side areas angled forward or upward where the bucket seat sides are angled inward, and finally additional outwardly directed "wings" to assure free inward flow of cooling and ventilating air.

16 Claims, 2 Drawing Sheets

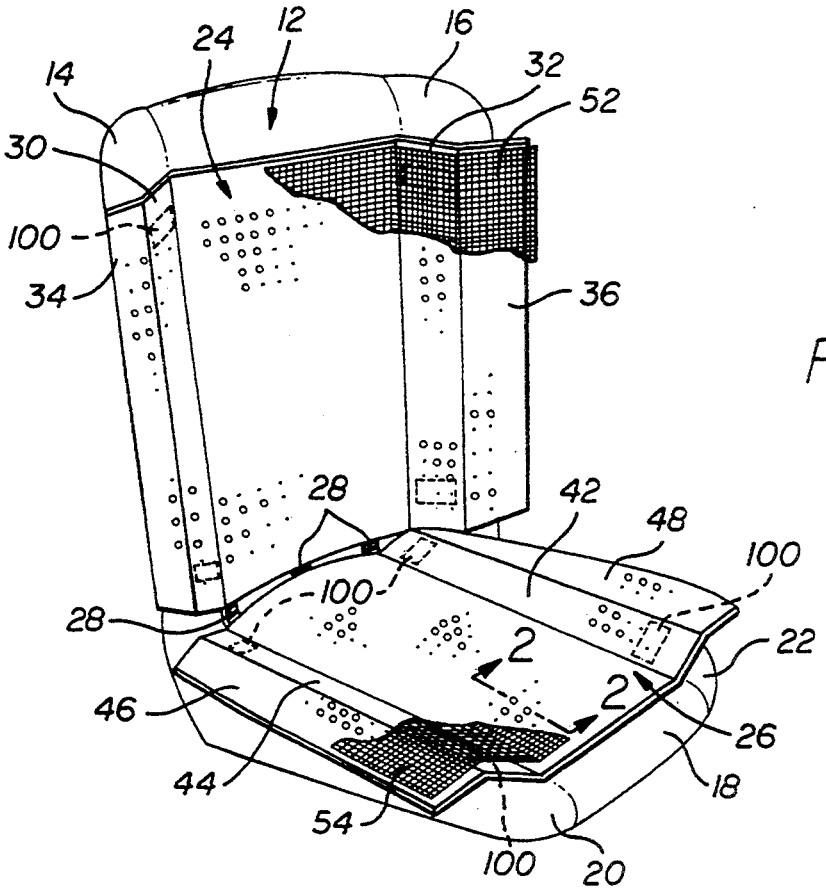
FIG. 1
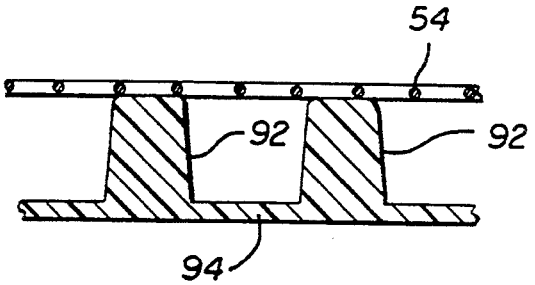
FIG. 2
FIG. 3
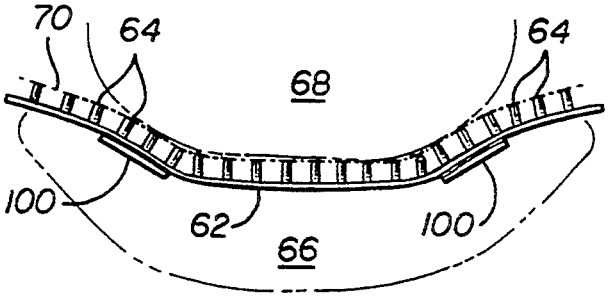

EXTENDED VENTILATING SEAT COVERING ASSEMBLY

FIELD OF THE INVENTION

This invention relates to coverings for seats, such as automobile seats, which cool and massage the user of the seat.

BACKGROUND OF THE INVENTION

Various covering assemblies for seats have been proposed heretofore for cooling and/or massaging the user of the seat, such as the driver of an automobile. In this regard, one known arrangement uses an array of beads which are intended to extend over the normal seating area. F. Karver U.S. Pat. No. 3,132,523 and my prior U.S. Pat. No. 4,981,324 both show seat covering arrangements which blow air under pressure onto the driver. Further, H. H. Trotman et al., U.S. Pat. Nos. 4,313,640 and 4,435,015 both show arrays of studs which protrude from rear sheet members, but where the assembly is sealed around its outer edges.

However, all of these arrangements suffer from serious drawbacks. For example, in the bead arrangements, little ventilation occurs. The forced air systems, while they appear to have potential for achieving the desired ventilation and cooling, are expensive and elaborate to implement. Finally, the Trotman systems with the raised studs appear promising, but the sealed peripheries of the units prevents the flow of ventilation air from the ambient to the user's seating areas, including to the back and underneath the user.

SUMMARY OF THE INVENTION

Accordingly, a principal object of the present invention is to provide a simple, inexpensive, and effective seat covering assembly which will cool the user by permitting the free circulation of air, and which may also massage the user to relieve stiffness from prolonged sitting.

In accordance with the invention, an extended ventilated seat covering assembly includes a backing sheet provided with an array of studs, protrusions or spacing members extending outwardly from the backing sheet for supporting the body of the user, with the backing sheet and spacing members extending laterally beyond the normal seating area, and with the assembly being open at the outer sides thereof to permit the free flow of ventilating and cooling air to the surface of the body of the user.

In addition to providing ventilation, the support of the body at a series of spaced points provides a healthful massaging action, relieving stress and muscle fatigue during prolonged sitting, for the driver of a vehicle, or the like.

In one preferred embodiment the studs, protrusions or spacing members are about $\frac{1}{2}$ inch in length, and are spaced center to center by about $\frac{3}{4}$ inch, and the outer ends are about $\frac{1}{4}$ inch in diameter, providing a spacing of about $\frac{1}{2}$ inch from the facing sides of adjacent studs. The lateral extent of the assemblies are preferably about 20 to 24 inches to ensure extension laterally beyond the normal seating area of a user.

More generally, the outwardly extending studs, protrusions or spacing members may have any desired length, from about $\frac{1}{4}$ inch to about $\frac{3}{4}$ inch, with the spacing between the studs being preferably between about $\frac{1}{4}$ inch and $\frac{3}{4}$ inch, to facilitate the free flow of air.

Further, these protrusions may be slightly tapered to facilitate molding, and each stud may have an average cross-sectional diameter in the order of from 5/32 inch to $\frac{5}{8}$ inch.

In addition, particularly for contoured or bucket seats which partially enclose the sides of the user, the seat covering assemblies may have open "wings" which extend outwardly beyond the enclosing sides of the conformed seats, to ensure the free inward flow of ventilating air.

The backing sheet and the protruding spacing members may be formed of plastic, with the studs or protrusions being either solid or hollow depending on the method of manufacture, and having slightly rounded or chamfered outer edges.

The ends of the studs, protrusions or spacing members away from the backing sheet may be covered with an open screen or a thin flat woven sheet such as the caning used on chairs, preferably or formed of thin, light-weight strands of plastic. In the event that such outer open screen or sheet is employed, care must be exercised to leave the outer edges of the assembly open for the free flow of ventilating air. The inner ends of the spacing members may alternatively be provided with individual outer ends of resilient material.

When an open screen or a thin flat woven sheet is used, the space between the adjacent spacing members can be much bigger in comparison with the case in which an open screen on a thin flat woven sheet is not used.

Other objects, features and advantages of the invention will become apparent from a consideration of the following detailed description and the accompanying drawings.

BRIEF DESCRIPTION OF THE DRAWINGS

FIG. 1 shows a bucket seat equipped with a ventilated seat covering illustrating the principles of the invention;

FIG. 2 a partial cross-sectional view taken along lines 2—2 of FIG. 1;

FIG. 3 illustrates the extension of the seat covering assembly beyond the normal seating area of the user;

DETAILED DESCRIPTION OF PREFERRED EMBODIMENTS

Figure 4:
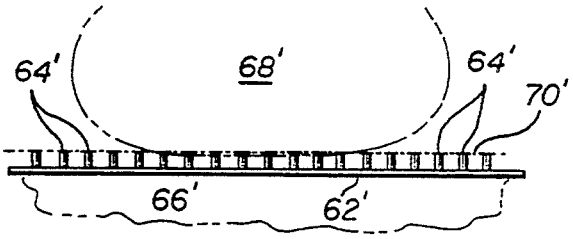
FIG. 4 a diagrammatic showing of an embodiment of the invention as used with a bench type automobile seat.

Referring more particularly to the drawings, FIG. 1 shows a bucket seat having a backrest portion 12 with inturned side portions or wings 14 and 16, and a seat portion 18 with raised side zones 20 and 22. The backrest and seat covering assembly illustrating the principles of the invention, includes an upper portion 24 and a lower portion 26 which may be separate or may be intercoupled by a flexible coupling strips 28, or may be made in one piece with a hinge interconnecting the two parts.

The upper section 24 includes outer zones 30 and 32 which generally overlie the inturned wing portions 14 and 16 of the backrest, and further include the outer zones 34 and 36 which extend outward beyond the normal seating area 12, 14, 16 where the user's body would normally engage the backrest. Similarly, the lower seat covering assembly 26 includes adjacent outer areas 42 and 44 which would normally be engaged by the user, and additional outer wings 46 and 48 coupled to zones 42 and 44, respectively, and extending beyond the normal seating area of the user.

The entire surface of the seat covering assembly may optionally have an open mesh or lattice sheet 52 covering the back rest portion thereof, and a similar open mesh or lattice sheet 54 on the lower seat portion. This additional open sheet material may be formed of very thin flat woven plastic strands, somewhat similar to the canning used on certain chairs, but having a very open structure to permit full ventilation.

Whether or not the inner mesh sheet or layer is used, the outer peripheries of the assemblies are fully open and not bound together, so that air may enter the sides and top of front of the assemblies to cool the user. This is in contrast to the prior art arrangements mentioned above in which the outer edges were bound in construction, with the peripheral binding severely limiting air flow; and in other of these prior art arrangements the assemblies were confined to the seating areas themselves, so that the user's body would extend beyond the edges thereof, which would also limit or severely restrict air flow.

FIG. 3 is a diagrammatic showing of a seat covering and supporting assembly, including a base sheet 62, with studs, protrusions or spacing members 64, overlying the body conforming seat 66 and supporting the back or the seat of the user 68; and FIG. 4 is a similar showing of a base sheet 62' with protruding support studs 64' between a relatively flat bench seat 66' and the user 68'. In the assemblies of FIGS. 3 and 4, the optional open screen or open woven cover sheet 70 or 70' is shown in dashed lines. Note that in both the arrangement of FIG. 3 and that of FIG. 4, the seat covering assembly extends on either side well beyond the normal seating area of the user, and is entirely open at the outer edges, to ensure the free access of ventilating and cooling air to the facing body of the user.

Figure 5:
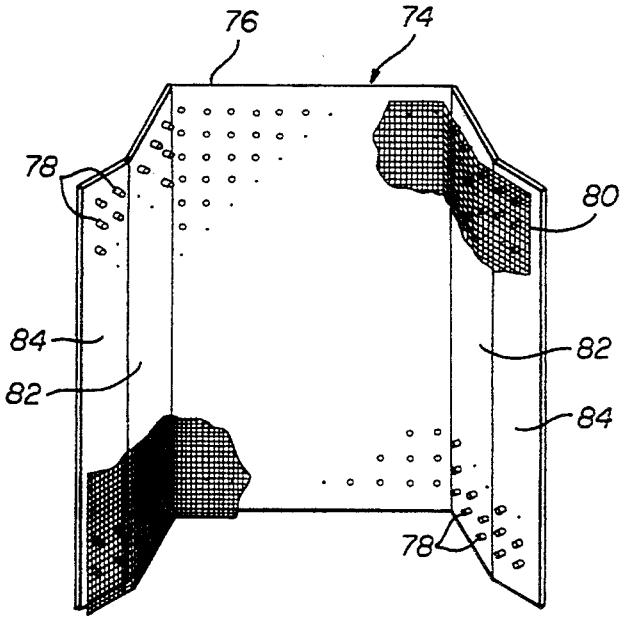
FIG. 5 shows a unitary assembly illustrating the principles of the invention which may be used either as a back rest or below the user, individually, or in combination with a second assembly.

FIG. 5 is a diagrammatic showing of an assembly 74 which may be used either as a back rest, or underneath the user. The assembly 74 includes the back sheet 76, the protrusions 78, and an optional open mesh or screen sheet 80. The assembly 74 includes the side members 82, and the outer wings 84 open at their outer edges to permit full ventilation, as discussed above in connection with the other embodiments described hereinabove.

Figure 6:
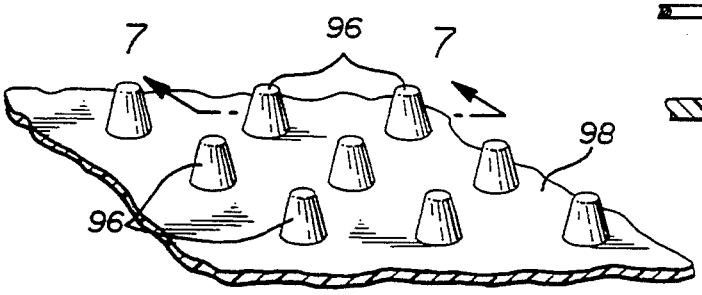
FIG. 6 is an enlarged view of an alternative form of stud, protrusion or spacing member.
Figure 7:
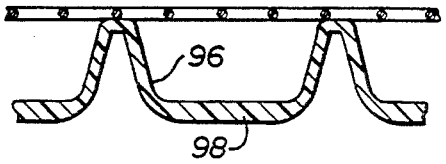
FIG. 7 is a cross-sectional view taken along the plane indicated at 7—7 of FIG. 6.

Now, referring to FIGS. 2, 6 and 7, the studs, protrusions or spacing members as used in the assemblies of FIGS. 1, 4 and 5, may be formed in a number of different ways. In FIG. 2, the protrusions or spacing members 92 are shown solid and integral with the backing or base sheet 94; while in the embodiment of FIGS. 6 and 7, the spacing members 96 are formed as protrusions or indentations from the sheet material forming the backing sheet 98. As a method of manufacture, the configuration as shown in FIGS. 6 and 7 may be formed from sheet plastic material which is heated and to which heated mating opposed dies, having matching protrusions and recesses, are applied. These dies may, for example, be in the form of synchronized heated rollers through which a long or continuous strip of sheet plastic is processed.

The embodiment of FIG. 2 may be molded or the studs or protrusions may be formed separately in frustro-conical or cylindrical shape, and bonded to a base sheet 94.

In one model which has been constructed and tested, the protrusions were cylindrical and were adhesively bonded to the backing sheet. In this model the protrusions were tubular and about $\frac{1}{4}$ inch in diameter and about $\frac{1}{2}$ inch long, and were spaced apart, center-to-center by $\frac{3}{4}$ inch, and $\frac{1}{2}$ inch between facing sides. More generally, any spacing which provides good ventilation and comfortable support for the body may be used; and it is contemplated that the height of the protrusions should be between $\frac{1}{4}$ and $\frac{3}{4}$ inch in height, and preferably between $\frac{3}{8}$ and $\frac{5}{8}$ inch. The diameter of the outer ends of the studs may vary from $\frac{1}{8}$ inch to $\frac{5}{8}$ inch, with 3/16 to $\frac{1}{2}$ inch being preferred. The spacing between the facing surfaces of adjacent studs is preferably between $\frac{1}{4}$ inch and $\frac{3}{4}$ inch.

Concerning the thickness of the sheet material, this will vary with the strength and flexibility of the sheet plastic which is used, and can vary from a few thousandths of an inch up to $\frac{1}{8}$ inch with a thickness of about 0.010 inch or 10 mils to about 0.040 inch or 40 mils being preferred. A sheet material is chosen so that it is strong enough to hold the studs in position, but flexible enough to follow the configuration of the seat. It is preferred that the outer edges of the protrusions are slightly rounded or chamfered, and that they are slightly resilient. This permits slight movement of the user on the assembly, and provides a light massaging action when the assembly is used as a car seat covering, during normal motion of the vehicle.

The seat covering assemblies are held in place on the seats by any desired securing means such as mating pads of hook and loop type material such as VELCRO, with mating pads of this type being shown at reference numeral 100 in FIGS. 1 and 3 of the drawings. Preferably, the loop, type material pads are secured, for example, by pressure sensitive adhesive to the seats, while the hook type pads are affixed to the seat covering assemblies, so that when the seat covering assemblies are not used, the users clothing will not be gripped by the pads.

Concerning one additional matter, the lateral extent of the normal seating area of the user is about 12 to 18 inches, with a seating area of 20 inches across accommodating more than 95% of the population. Accordingly, the lateral dimensions of the seat covering assemblies is normally greater than the lateral extent of the normal seating area, or at least 19 inches, and preferably 22 inches, and with wide sizes having an extent of 26 inches to accommodate unusually large users. It is again noted that the outer edges of the seat covering assemblies are open and no edge binding is employed to secure the open sheet material 52, or otherwise, so that free ventilation from the sides (and top or bottom where not blocked by the users body) may occur.

In conclusion, it is to be understood that the foregoing detailed description and the accompanying drawings are directed to illustrative embodiments of the invention, and that variations and alternatives thereto are contemplated. Thus, by way of example and not of limitations, the studs or spacing members may be formed of a resilient material, such as rubber, instead of plastic. Further, the backing sheet may be relatively flexible and may be pulled taut over and secured to the seat at its edges and at points where the seat surface changes shape, instead of being of relatively stiff, but flexible and conforming plastic, as described hereinabove. Further, instead of being confined to a single person's seat, the covering assembly may extend all of the way across a bench type automobile seat, if desired. Alternatively, separate assemblies of the type shown in FIG. 1 may be provided for automobile passengers as well as for the driver. It is further noted that the protrusions may be oval or rectangular instead of the disclosed circular cross-sectional configuration. In addition, instead of using mating hook and loop material pads, the assemblies may be secured to the seats by straps, snaps or reusable pressure sensitive adhesive. Also, another kind of spacing mechanism may be utilized. For example, a frame or grid made of cane, plastic or other material can be employed, an open screen would overlie this frame, and the frame or grid would be supported from the base plate by fairly widely spaced supporting members or studs. Accordingly, the invention is not limited to the specific arrangements as shown in the drawings and described in detail hereinabove.

What is claimed is:

1. An extended ventilated seat covering and bucket seat assembly comprising:

a bucket seat having a back with a central area for supporting the back of a user, and forwardly extending side portions or wings;

a base sheet extending over said central area of said bucket seat and substantially beyond said area;

a plurality of spacing members extending out from said base sheet generally perpendicular with respect to said base sheet, with said spacing members and the outer ends thereof providing means for spacing the body of the user away from the bucket seat and said base sheet;

said spacing members being at least $\frac{1}{4}$ inch long and being spaced apart from one-another by at least $\frac{1}{4}$ inch;

said base sheet and said spacing members forming an assembly which is fully open at the sides thereof, to permit the free circulation of air in from the edges of said assembly to cool the user of the bucket seat;

said ventilated seat covering having a central area extending over said central area of said bucket seat, side areas angled forward from said central area and extending along the forwardly extending portions of the bucket seat, and additional wing portions angled outwardly from said side portions beyond said side portion of said bucket seats, to ensure the free flow of air inward, unblocked by the body of the user; and said base sheet being clearly visible from the front of the ventilated seat covering, to assure free flow of air through the surface of said seat covering away from said base sheet.

2. An assembly as defined in claim 1 further comprising means for removably securing said assembly to said bucket seats.

3. An extended ventilated seat covering assembly as defined in claim 1 further including an open screen overlying said spacing members to provide more even support to the user, while permitting full ventilation or air circulation.

4. An extended ventilated seat covering assembly as defined in claim 1 wherein the lateral dimension of said assembly is at least 12 inches.

5. An extended ventilated seat covering assembly as defined in claim 1 wherein said base sheet and said spacing members are molded from a single sheet of slightly flexible and conformable plastic.

6. An extended ventilated seat covering assembly as defined in claim 1 wherein said spacing members are resilient.

7. An extended ventilated seat covering assembly as defined in claim 1 wherein the lateral dimension of said assembly is at least 18 inches.

8. An extended ventilated seat covering assembly as defined in claim 1 wherein the spacing members are between $\frac{1}{4}$ inch and $\frac{3}{4}$ inch in length.

9. An extended ventilated seat covering and bucket seat assembly comprising:

a bucket seat having a back with a central area for supporting the back of a user, and forwardly extending side portions or wings, and a seat with a central area for supporting the seat of a user and upwardly and outwardly extending side portions;

base sheets extending over said central areas of said bucket seat, and substantially beyond said areas;

a plurality of spacing members extending out from said base sheets generally perpendicular with respect to said base sheets, with said spacing members and the outer ends thereof providing means for spacing the body of the user away from the bucket seat and said base sheets;

said spacing members being at least $\frac{1}{4}$ inch long and being spaced apart from one-another by at least $\frac{1}{4}$ inch;

said base sheets and said spacing members forming an assembly which is fully open at the sides thereof, to permit the free circulation of air in from the edges of said assembly to cool the user of the bucket seat;

said ventilated seat covering having central areas extending over the central areas of said bucket seat to be engaged by the back or the seat of the user, side areas angled away from said central area and extending along the side portions of the bucket seat, and additional portions extending outwardly from said side portions beyond said side portions of said bucket seats, to ensure the free flow of air inward, unblocked by the body of the user;

said base sheets being clearly visible from the front of the ventilated seat covering to assure free flow of air through the surface of said seat covering away from said base sheet; and said central area of said seat covering associated with said back being hingedly coupled to said central area of said seat covering associated with said seat of said bucket seat.

10. An extended ventilated seat covering assembly as defined in claim 9, wherein said spacing members extend at least $\frac{1}{4}$ inch out from said base sheet.

11. An extended ventilated seat covering assembly as defined in claim 9 further including a porous, open screen or sheet overlying said spacing members to provide more even support to the user, while permitting full ventilation or air circulation.

12. An extended ventilated seat covering assembly as defined in claim 9 wherein the lateral dimension of said assembly is at least 12 inches.

13. An extended ventilated seat covering assembly as defined in claim 9 wherein the lateral dimension of said assembly is at least 18 inches.

14. An extended ventilated seat covering assembly as defined in claim 9 wherein said base sheet and said spacing members are molded from a single sheet of plastic.

15. An extended ventilated seat covering assembly as defined in claim 9 wherein said spacing members are resilient.

16. An extended ventilated seat covering assembly as defined in claim 9 wherein the spacing members are between $\frac{1}{4}$ inch and $\frac{3}{4}$ inch in length.

* * * * *